US012623127B1

(12) United States Patent
Zhang

(10) Patent No.: US 12,623,127 B1
(45) Date of Patent: May 12, 2026

(54) HEAD FRAME WITH TELESCOPIC HANDLE

(71) Applicant: Dongguan Yaoyu Plastic Hardware Products Co., Ltd., Dongguan (CN)

(72) Inventor: Zujie Zhang, Dongguan (CN)

( * ) Notice: Subject to any disclaimer, the term of this patent is extended or adjusted under 35 U.S.C. 154(b) by 0 days.

(21) Appl. No.: 19/004,219

(22) Filed: Dec. 28, 2024

(51) Int. Cl.
*A63B 55/00* (2015.01)

(52) U.S. Cl.
CPC ..... *A63B 55/00* (2013.01)

(58) Field of Classification Search
CPC ..... A63B 55/00
USPC ..... 190/115
See application file for complete search history.

(56) References Cited

U.S. PATENT DOCUMENTS 10,786,715 B2 * 9/2020 Wang ..... A63B 55/40
2011/0315578 A1 * 12/2011 Shiao ..... A63B 55/40 206/315.6
2014/0061075 A1 * 3/2014 Leposky ..... A63B 55/00 206/315.3

FOREIGN PATENT DOCUMENTS

CN 211935458 U * 11/2020

* cited by examiner

*Primary Examiner* — Don M Anderson
*Assistant Examiner* — Justin Caudill
(74) *Attorney, Agent, or Firm* — Sandy Lipkin

(57) ABSTRACT

The present invention discloses a head frame with a telescopic handle, the head frame including a head frame main body and a handle. A female plug structure is fixed on a side wall of the head frame main body. The handle is U-shaped, and a male plug structure is provided at an end portion of the handle. The male plug structure is provided with a strip-shaped groove, and the female plug structure is provided with a fastening hole. A matching fastening bolt is provided in the fastening hole, and the fastening bolt is located in the strip-shaped groove.

6 Claims, 5 Drawing Sheets

HEAD FRAME WITH TELESCOPIC HANDLE

BACKGROUND OF THE INVENTION

Field of the Invention

The present invention relates to the field of leisure sports goods, and in particular to a golf bag.

Description of Related Art

The top of a golf bag is provided with an outer frame for people to lift the golf bag, and a handle is provided on the outer frame. People drag the entire golf bag by the handle. Due to many factors in the external environment, there is a certain degree of inevitable bumps when carrying the golf bag, resulting in different degrees of collision of the golf bag. At present, since the outer frame of the golf bag and the handle thereof are locked with each other, there is no buffer space on the handle when carrying the golf bag, and the golf bag is easily collided with a large impact during the dragging process, resulting in wear and damage to the golf bag, which is inconvenient for people to use and has poor practicality.

To solve the above technical problem, the patent document with the authorization announcement number CN211935458U discloses an anti-collision frame structure of a golf bag. The anti-collision frame structure includes a head frame and a hand-held portion. A first attachment portion and a second attachment portion which are symmetrical to each other are provided on both sides of the head frame, respectively, and the first attachment portion and the second attachment portion are each provided with an attachment hole. Connecting blocks matching the attachment holes are provided on both ends of the hand-held portion, respectively, and the connecting blocks are provided with sliding grooves. The hand-held portion can be slidably clamped in the attachment holes of the first attachment portion and the second attachment portion through the connecting blocks, and the first attachment portion and the second attachment portion are each provided with an anti-falling screw penetrating in the sliding groove. According to the patent document, the handle fixed on the traditional outer frame is designed as a telescopic structure, and thus a buffer space is formed between the outer frame and the hand-held portion, which can effectively avoid collision during dragging and reduce a collision impact force of the golf bag, thereby achieving the effect of protecting the golf bag.

In the patent document, the anti-falling screw can move along the sliding groove, and when the hand-held portion is collided during dragging, the hand-held portion can be retracted into the outer frame. In this way, relative to the outer frame, the hand-held portion has only two stop positions, one of which is when the anti-falling screw is at one end of the sliding groove, the hand-held portion is in an extended state. The other position is when the anti-falling screw is at the other end of the sliding groove, the hand-held portion is in a retracted state.

SUMMARY OF THE INVENTION

The technical problem to be solved by the present invention is to enable the hand-held portion to stop at a plurality of positions with respect to a head frame main body, so as to facilitate a user to adjust the position of the hand-held portion by himself/herself.

To solve the above technical problem, the present invention provides the following technical solutions. A head frame with a telescopic handle, the head frame including: a head frame main body; and a handle, in which a female plug structure is fixed on a side wall of the head frame main body, the handle is U-shaped, and a male plug structure is provided at an end portion of the handle, the male plug structure is provided with a strip-shaped groove, and the female plug structure is provided with a fastening hole, a matching fastening bolt is provided in the fastening hole, and the fastening bolt is located in the strip-shaped groove, the male plug structure is provided with a plurality of limit slots, which are distributed along a length direction of the male plug structure, and the female plug structure is provided with an elastic piece, which is capable of matching any of the limit slots.

With respect to the head frame main body, a user pulls out or retracts the handle, and the male plug structure moves relative to the female plug structure. According to an amount of movement of the male plug structure relative to the female plug structure, the elastic piece passes over a certain number of limit slots and finally matches one of the limit slots, and the handle is initially positioned on the head frame main body. Then, the user tightens the fastening bolt, which causes the female plug structure to clamp the male plug structure, thereby fixing the position of the handle on the head frame main body.

The female plug structure and the male plug structure are both hollow and flat. When the user tightens the fastening bolt, the flat structural design facilitates large-area contact between the female plug structure and the male plug structure. Further, the hollow male plug structure can be elastically deformed, and resilience thereof can cause an outer side wall of the male plug structure to come into close contact with an inner side wall of the female plug structure, which facilitates a fixed connection between the female plug structure and the male plug structure.

The limit slots are provided at a bottom portion of the male plug structure and have a tooth shape, and the elastic piece is provided with a tooth-shaped protrusion matching the limit slot. In a case where the male plug structure moves relative to the female plug structure, the tooth-shaped protrusion of the elastic piece is forced to undergo elastic deformation when leaving the matching limit slot, and then, when the tooth-shaped protrusion is aligned with another limit slot, the tooth-shaped protrusion is reset and matches that limit slot.

The elastic piece includes a pair of U-shaped structures, and openings of the pair of U-shaped structures are disposed opposite to each other. The tooth-shaped protrusion is connected to the pair of U-shaped structures and located above the pair of U-shaped structures, and the elastic piece is formed by bending a strip-shaped elastic piece. A ridge-shaped groove extending into the female plug structure is provided on an inner side wall of the head frame main body, and the elastic piece is embedded in the female plug structure through the ridge-shaped groove.

An auxiliary sleeve structure is provided on the side wall of the head frame main body. The auxiliary sleeve structure and the female plug structure are aligned front and back and have a certain distance therebetween, and the male plug structure passes through the auxiliary sleeve structure and is inserted into the female plug structure. The auxiliary sleeve structure facilitates a stable connection between the male plug structure and the head frame.

According to the head frame with a telescopic handle of the present invention, the limit slots match the elastic piece, which provides a mechanical feel when adjusting the position of the handle, and can synchronously position the male plug structures at both ends of the handle to avoid a difference in a telescopic range at both ends of the handle. The fastening bolt can fix the handle at a position required by the user.

BRIEF DESCRIPTION OF THE DRAWINGS

The present invention will be further described below with reference to the accompanying drawings.

REFERENCE SIGNS LIST

10: head frame main body, 11: female plug structure, 12: fastening hole, 13: ridge-shaped groove, 14: auxiliary sleeve structure, 20: handle, 21: male plug structure, 22: strip-shaped groove, 23: limit slot, 30: elastic piece, 31: tooth-shaped protrusion, 32: U-shaped structure

DETAILED DESCRIPTION OF THE INVENTION

Figure 1:
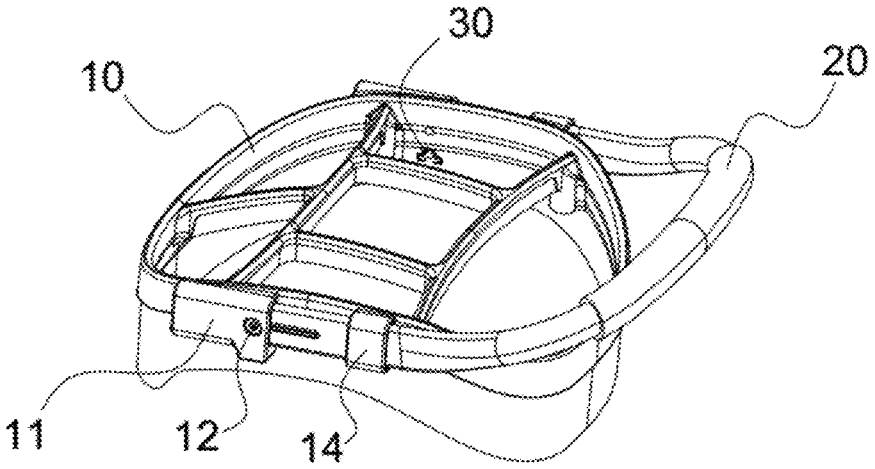
FIG. 1 is a schematic diagram of a head frame with a telescopic handle.
Figure 2:
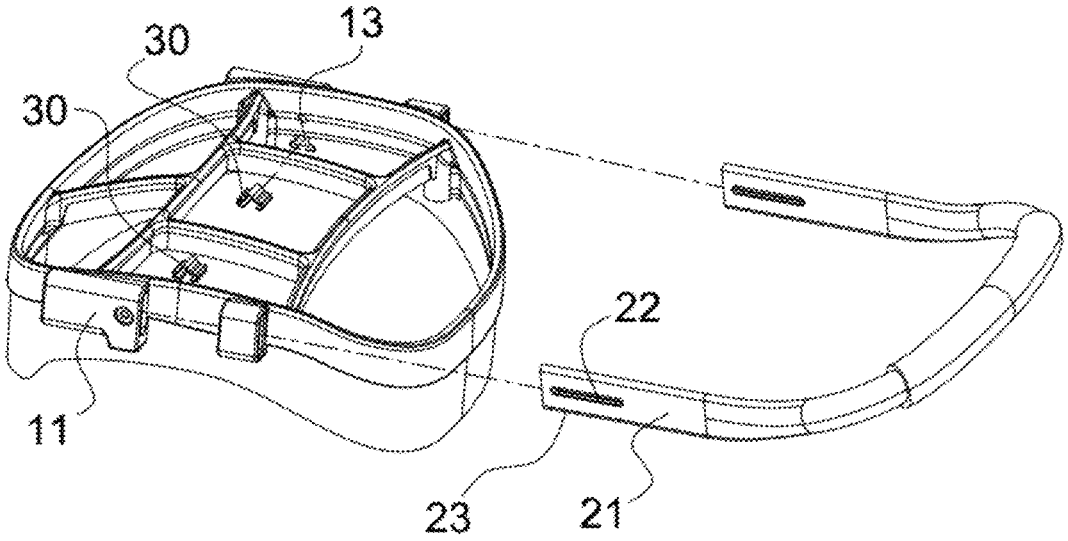
FIG. 2 is an exploded view of FIG. 1.

With reference to FIGS. 1 and 2, a head frame with a telescopic handle includes a head frame main body 10 and a handle 20. A female plug structure 11 is fixed on a side wall of the head frame main body. The handle is U-shaped, and a male plug structure 21 is provided at an end portion of the handle. The male plug structure is provided with a strip-shaped groove 22, and the female plug structure is provided with a fastening hole 12. A matching fastening bolt is provided in the fastening hole, and the fastening bolt is located in the strip-shaped groove. The male plug structure is provided with a plurality of limit slots 23, which are distributed along a length direction of the male plug structure. The female plug structure is provided with an elastic piece 30, which is capable of matching any of the limit slots.

Figure 3:
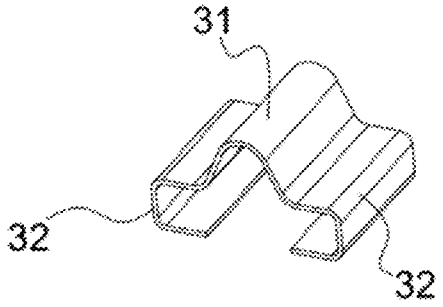
FIG. 3 is a schematic diagram of an elastic piece 30.
Figure 5:
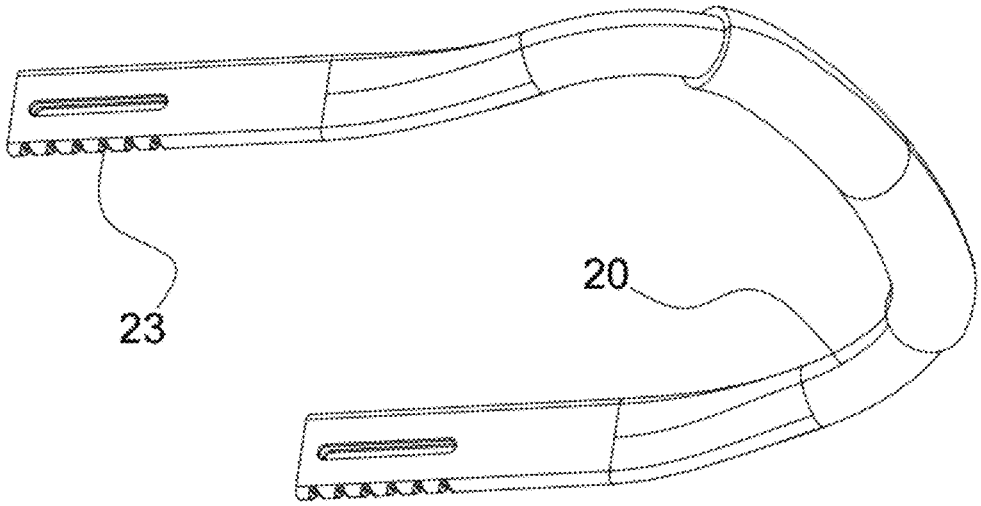
FIG. 5 is a schematic diagram of a handle 20.

The female plug structure 11 and the male plug structure 21 are both hollow and flat. With reference to FIGS. 5 and 3, the limit slots 23 are provided at a bottom portion of the male plug structure 11 and have a tooth shape, and the elastic piece 30 is provided with a tooth-shaped protrusion 31 matching the limit slot.

Figure 4:
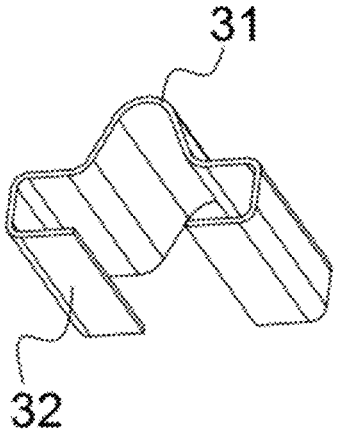
FIG. 4 is a schematic diagram of the elastic piece 30 from another viewing angle.

With reference to FIGS. 3 and 4, the elastic piece 30 includes a pair of U-shaped structures 32, and openings of the pair of U-shaped structures are disposed opposite to each other. The tooth-shaped protrusion 31 is connected to the pair of U-shaped structures and located above the pair of U-shaped structures, and the elastic piece is formed by bending a strip-shaped elastic piece.

As shown in FIG. 2, a ridge-shaped groove 13 extending into the female plug structure 11 is provided on an inner side wall of the head frame main body 10, and the elastic piece 30 is embedded in the female plug structure through the ridge-shaped groove.

An auxiliary sleeve structure 14 is provided on the side wall of the head frame main body 10. The auxiliary sleeve structure and the female plug structure 11 are aligned front and back and have a certain distance therebetween, and the male plug structure 21 passes through the auxiliary sleeve structure and is inserted into the female plug structure.

With respect to the head frame main body 10, a user pulls out or retracts the handle 20, and the male plug structure 21 moves relative to the female plug structure 11. The tooth-shaped protrusion 31 of the elastic piece is forced to undergo elastic deformation when leaving the matching limit slot 23, and then, when the tooth-shaped protrusion 31 is aligned with another limit slot, the tooth-shaped protrusion 31 is reset and matches that limit slot. According to an amount of movement of the male plug structure 21 relative to the female plug structure 11, the elastic piece 30 passes over a certain number of limit slots 23 and finally matches one of the limit slots, and the handle 20 is initially positioned on the head frame main body 10. Then, the user tightens the fastening bolt, which causes the female plug structure 11 to clamp the male plug structure 21, thereby fixing the position of the handle 20 on the head frame main body 10.

The above contents are merely a preferred embodiment of the present invention. For those skilled in the art, according to the concept of the present invention, changes may be made in specific embodiments and application scopes, and the contents of the present specification should not be understood as a limitation on the present invention. The present invention discloses a head frame with a telescopic handle, the head frame including a head frame main body and a handle. A female plug structure is fixed on a side wall of the head frame main body. The handle is U-shaped, and a male plug structure is provided at an end portion of the handle. The male plug structure is provided with a strip-shaped groove, and the female plug structure is provided with a fastening hole. A matching fastening bolt is provided in the fastening hole, and the fastening bolt is located in the strip-shaped groove. The male plug structure is provided with a plurality of limit slots, which are distributed along a length direction of the male plug structure. The female plug structure is provided with an elastic piece, which is capable of matching any of the limit slots. The limit slots of this design match the elastic piece, which provides a mechanical feel when adjusting the position of the handle, and can synchronously position the male plug structures at both ends of the handle to avoid a difference in a telescopic range at both ends of the handle. The fastening bolt can fix the handle at a position required by a user.

What is claimed is:

1. A head frame with a telescopic handle, the head frame comprising: a head frame main body (10); and a handle (20), wherein a female plug structure (11) is fixed on a side wall of the head frame main body, the handle is U-shaped, and a male plug structure (21) is provided at an end portion of the handle, the male plug structure is provided with a strip-shaped groove (22), and the female plug structure is provided with a fastening hole (12), a matching fastening bolt is provided in the fastening hole, and the fastening bolt is located in the strip-shaped groove, the male plug structure is provided with a plurality of limit slots (23), which are distributed along a length direction of the male plug structure, and the female plug structure is provided with an elastic piece (30), which is capable of matching any of the limit slots.

2. The head frame with a telescopic handle according to claim 1, wherein the female plug structure (11) and the male plug structure (21) are both hollow and flat.

3. The head frame with a telescopic handle according to claim 2, wherein the limit slots (23) are provided at a bottom portion of the male plug structure (11) and have a tooth shape, and the elastic piece (30) is provided with a tooth-shaped protrusion (31) matching the limit slot.

4. The head frame with a telescopic handle according to claim 3, wherein the elastic piece (30) includes a pair of U-shaped structures (32), openings of the pair of U-shaped structures are disposed opposite to each other, the tooth-shaped protrusion (31) is connected to the pair of U-shaped structures and located above the pair of U-shaped structures, and the elastic piece is formed by bending a strip-shaped elastic piece.

5. The head frame with a telescopic handle according to claim 4, wherein a ridge-shaped groove (13) extending into the female plug structure (11) is provided on an inner side wall of the head frame main body (10), and the elastic piece (30) is embedded in the female plug structure through the ridge-shaped groove.

6. The head frame with a telescopic handle according to claim 1, wherein an auxiliary sleeve structure (14) is provided on the side wall of the head frame main body (10), the auxiliary sleeve structure and the female plug structure (11) are aligned front and back and have a certain distance therebetween, and the male plug structure (21) passes through the auxiliary sleeve structure and is inserted into the female plug structure.

* * * * *